US007886542B2

(12) United States Patent
Blanchard et al.

(10) Patent No.: US 7,886,542 B2
(45) Date of Patent: Feb. 15, 2011

(54) DEVICE FOR ATTACHING A FLAME-ARRESTOR ARM TO AN AFTERBURNER CASING AND AFTERBURNER COMPRISING SUCH A DEVICE

(75) Inventors: Stephane Pierre Guillaume Blanchard, Chartrettes (FR); Yann Vuillemenot, Paris (FR)

(73) Assignee: Snecma, Paris (FR)

( * ) Notice: Subject to any disclaimer, the term of this patent is extended or adjusted under 35 U.S.C. 154(b) by 792 days.

(21) Appl. No.: 11/566,406

(22) Filed: Dec. 4, 2006

(65) Prior Publication Data

US 2007/0125086 A1 Jun. 7, 2007

(30) Foreign Application Priority Data

Dec. 5, 2005 (FR) ..... 05 12294

(51) Int. Cl.
*F02K 3/10* (2006.01)

(52) U.S. Cl. ..... 60/761; 60/763; 60/765

(58) Field of Classification Search ..... 60/761, 60/763, 765, 766, 796, 798
See application file for complete search history.

(56) References Cited

U.S. PATENT DOCUMENTS

| | | | | |
|---|---|---|---|---|
| 5,090,198 | A * | 2/1992 | Nightingale et al. | 60/763 |
| 5,359,849 | A | 11/1994 | Auffret et al. | |
| 5,396,763 | A * | 3/1995 | Mayer et al. | 60/765 |
| 5,497,616 | A * | 3/1996 | Roberts | 60/765 |
| 6,463,739 | B1 * | 10/2002 | Mueller et al. | 60/765 |

FOREIGN PATENT DOCUMENTS

| | | |
|---|---|---|
| EP | 0 713 057 A1 | 5/1996 |
| FR | 2 865 502 | 7/2005 |

* cited by examiner

*Primary Examiner*—Michael Cuff
*Assistant Examiner*—Vikansha S Dwivedi
(74) *Attorney, Agent, or Firm*—Oblon, Spivak, McClelland, Maier & Neustadt, L.LP.

(57) ABSTRACT

A device attaching an afterburner to a turbojet casing. The device comprises a transverse plate for attachment to the casing and at least two side brackets for supporting two legs of the afterburner. The brackets and the two legs extend longitudinally. The afterburner includes a flame-arrestor arm with the two legs.

17 Claims, 5 Drawing Sheets

DEVICE FOR ATTACHING A FLAME-ARRESTOR ARM TO AN AFTERBURNER CASING AND AFTERBURNER COMPRISING SUCH A DEVICE

1—BACKGROUND OF THE INVENTION

The present invention relates to the field of turbojet afterburners and more precisely the attachment of a flame-arrestor arm to an afterburner casing by means of an attachment and support device.

2—DESCRIPTION OF THE PRIOR ART

FIG. 1 represents a view in axial section of a dual-flow turbojet TR furnished with an afterburner. The turbojet TR conventionally comprises compressor stages CBP, CHP, and turbine stages THP, TBP to generate a primary flow F1 of burned gases discharged at high speed in a nozzle TY at the rear which provides the propulsion. A portion of the air from the compressor CBP is diverted into a secondary circuit F2 and rejoins the primary flow F1 in an afterburner chamber CPC at the nozzle TY to provide an additional burn and extra thrust.

The chamber PC contains afterburners that make it possible to inject fuel into the flows F1+F2 and provide this extra burn. The afterburner comprises a series of flame-arrestor arms 1 extending radially towards the axis of the jet TR (from an external casing to which they are attached), to which may be added a spray ring attached to the arms and placed around the circumference of the nozzle TR (ring not shown in FIG. 1; only its section appears in FIG. 2).

FIG. 2 shows in greater detail the disposition and mounting of a metal flame-arrestor arm on an external casing skirt according to the prior art.

The flame-arrestor arm may be made in monobloc form of composite material, particularly of Ceramic Matrix Composite (abbreviation CMC). CMCs are of value in that they withstand very high temperatures, particularly of the order of 1000° C. to 1500° C., such as those reached by the burning exhaust gases in the nozzle and in that they offer great mechanical strength and great rigidity for low weight. CMC materials in particular offer a higher strength-to-weight ratio than metals which is particularly sought after and appreciated in aviation.

However the attachment between an arm 1 made of CMC and a metal part, such as the casing or else a spray ring support 12 (see FIG. 2) is problematic.

On the one hand, CMC materials do not lend themselves very well to machining operations or to moldings of three-dimensional assembly shapes. In particular, drilling attachment holes in narrow flanges carries exposure to risks of tearing the CMC material.

On the other hand, the arm 1 sustains lateral forces because of the gyration of the flow in the nozzle which generates stresses and zones of deflection in the legs of the arm. The indented legs are not very resistant and particularly to a deflection when a lateral force or a tilting moment (low "moment of inertia" in particular when the legs are close together) is applied.

After such lateral forces, the fold lines between the legs and the flanges for attaching the arms sustain folding and unfolding effects. These forces may cause damage to the arm, particularly a tear along a fold line.

The object of the invention is to palliate the disadvantages of the current solutions and to propose a system of attaching an afterburner making it possible in particular to relieve the stresses sustained by the flame-arrestor arm during the lateral forces caused by the gyration of the flows in the stream.

Another object is to prevent making the arm support the whole weight of the spray ring segments at a location where it is weakened by the indents of the legs.

3—SUMMARY OF THE INVENTION

As a result, provision is made, according to the invention, to produce a device for attaching an afterburner to a turbojet casing, the afterburner comprising a flame-arrestor arm comprising two longitudinal legs, the device comprising a transverse plate for attachment to the casing and at least two side brackets for supporting said legs, the supporting brackets extending longitudinally.

Provision is made for the brackets to extend longitudinally over a length corresponding to at least a major portion of the height of the legs of the flame-arrestor arm.

Advantageously, the brackets comprise fixing means, especially holes, for laterally attaching the legs of the arm.

Provision is made for each bracket to comprise a thickened base. The base may comprise a rim furnished with a fillet on one external lateral surface. The bottom surface of each base may form a flat and/or a flat surface able to be brazed. Subsequently, the base of each longitudinal bracket may be fixedly attached to the transverse plate.

Provision is made for the plate to be furnished with means of attachment to the casing.

According to an advantageous feature, the device comprises at least one spray ring support flange.

According to another advantageous feature, the device comprises a bridge connector transversely connecting the longitudinal brackets.

Advantageously, the bridge connector comprises at least one orifice for the passage and immobilization of a ventilation sleeve and/or of a fuel injection bank.

According to an advantageous enhancement, provision is made for the plate to comprise edges furnished, on their internal side, with a groove and a protruding rim forming lateral hooks to immobilize the attachment flanges turned down at the end of the legs of the flame-arrestor arm.

In addition, provision is made for the edges of the plate to be furnished with means of immobilizing the flanges of the arm.

For example, provision can be made for the edges to comprise longitudinal threaded holes and/or caging bolts and also for the device to comprise at least one shim for immobilizing/compressing a flange for attachment of the arm.

The invention also relates to an afterburner comprising a flame-arrestor arm and such an attachment device. In addition, the afterburner may comprise at least one spray ring segment.

The invention further relates to a turbo-engine comprising at least one such afterburner.

4—DESCRIPTION OF THE DRAWINGS

Other features or advantages of the invention will clearly appear in the rest of the description, given as a nonlimiting example, with reference to the appended drawings in which:

FIG. 1, previously described, is a view in axial section of a turbojet that shows the placement of the flame-arrestor arm according to the prior art;

FIG. 2, previously described, is a detail view of a metal flame-arrestor arm and of its placement on an afterburner casing, according to the prior art;

5—DESCRIPTION OF THE PREFERRED EMBODIMENTS

Figure 4:
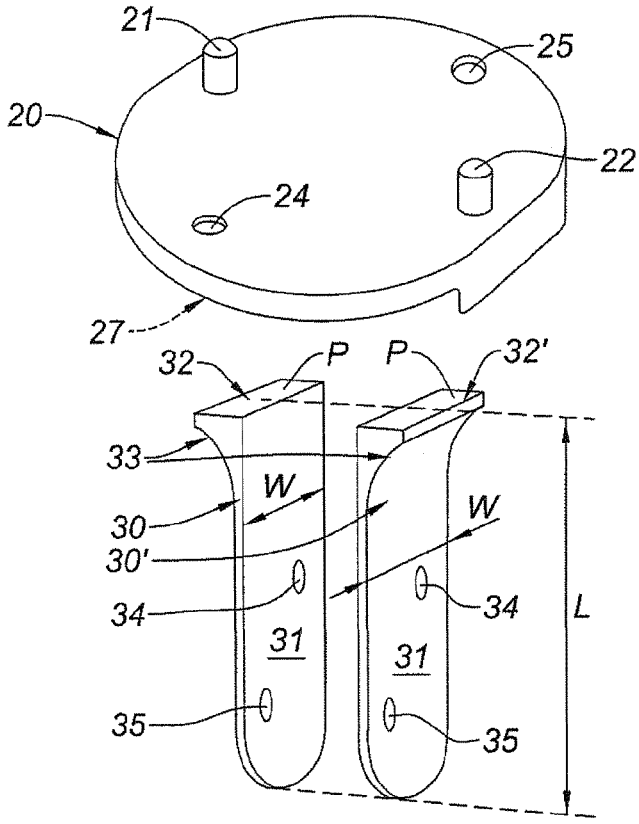
FIG. 4 represents an exploded view of the disconnected parts of a device for attaching a flame-arrestor arm according to a first embodiment of the invention.
Figure 5:
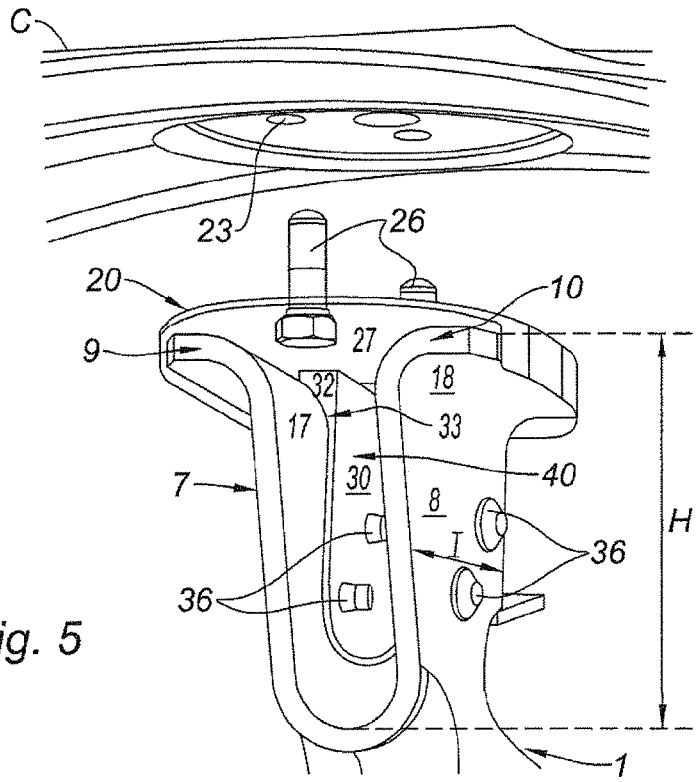
FIG. 5 shows the assembly of the device of FIG. 4 with a flame-arrestor arm and its attachment to a casing, according to the invention.

The diagram of FIG. 4 shows an attachment plate 20 and two lateral support brackets 30,30' that make it possible to form, as illustrated in FIG. 5, a device 40 for attaching a flame-arrestor arm 1 to a casing according to a first embodiment of the invention.

The pieces 20, 30 of the attachment device according to the invention are preferably made of metal or of metal alloy, especially titanium- or nickel-based.

Figure 3:
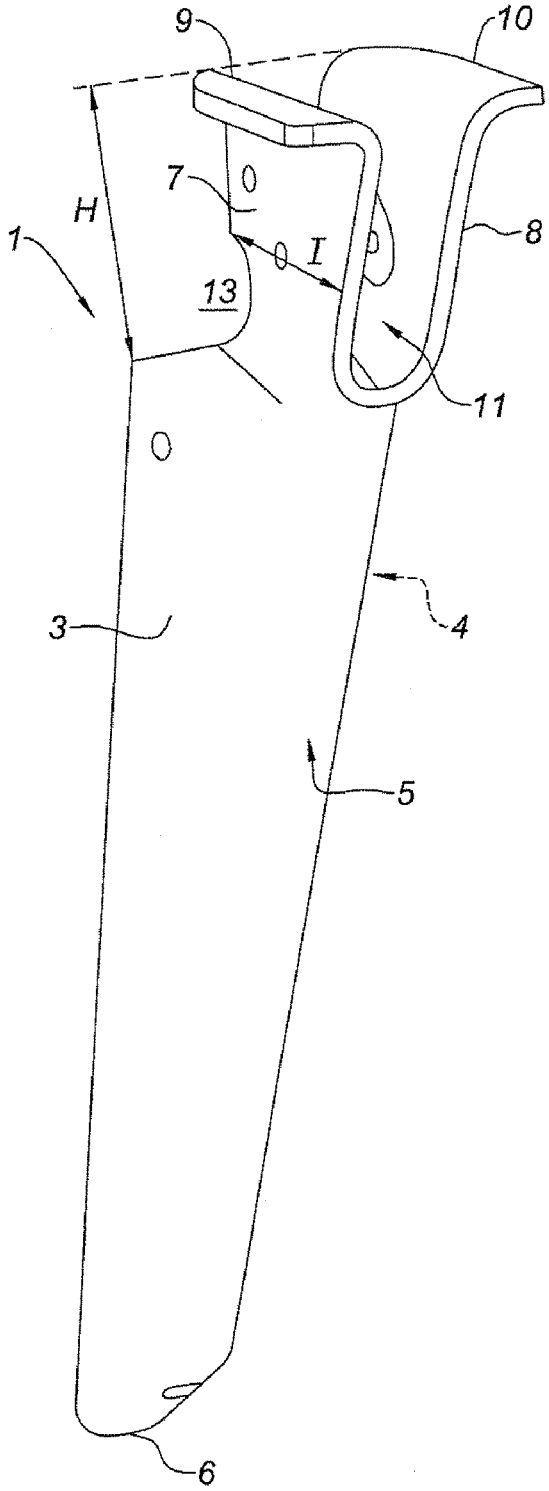
FIG. 3 represents a view in perspective of a flame-arrestor arm made of CMC material.

The flame-arrestor arm 1 is particularly a monobloc arm made of a composite material of the CMC (Ceramic Matrix Composite) type as illustrated in FIG. 3 and described in document FR-A-2 865 502 to which reference should be made for fuller details of production.

As illustrated in FIG. 3, the flame-arrestor arm 1 has the shape of a flared trough and comprises two lateral walls 3,4 connected at their summit 6 and being extended at their bases by two legs 7 and 8 furnished with turned-down flanges 9 and 10 for attachment to a casing skirt.

Figure 2:
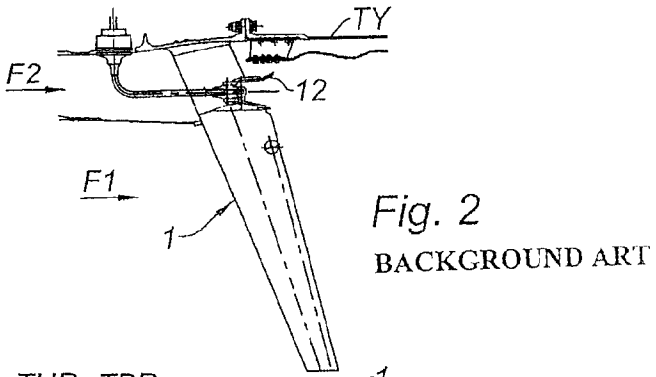
Fig. 2 BACKGROUND ART
Figure 1:
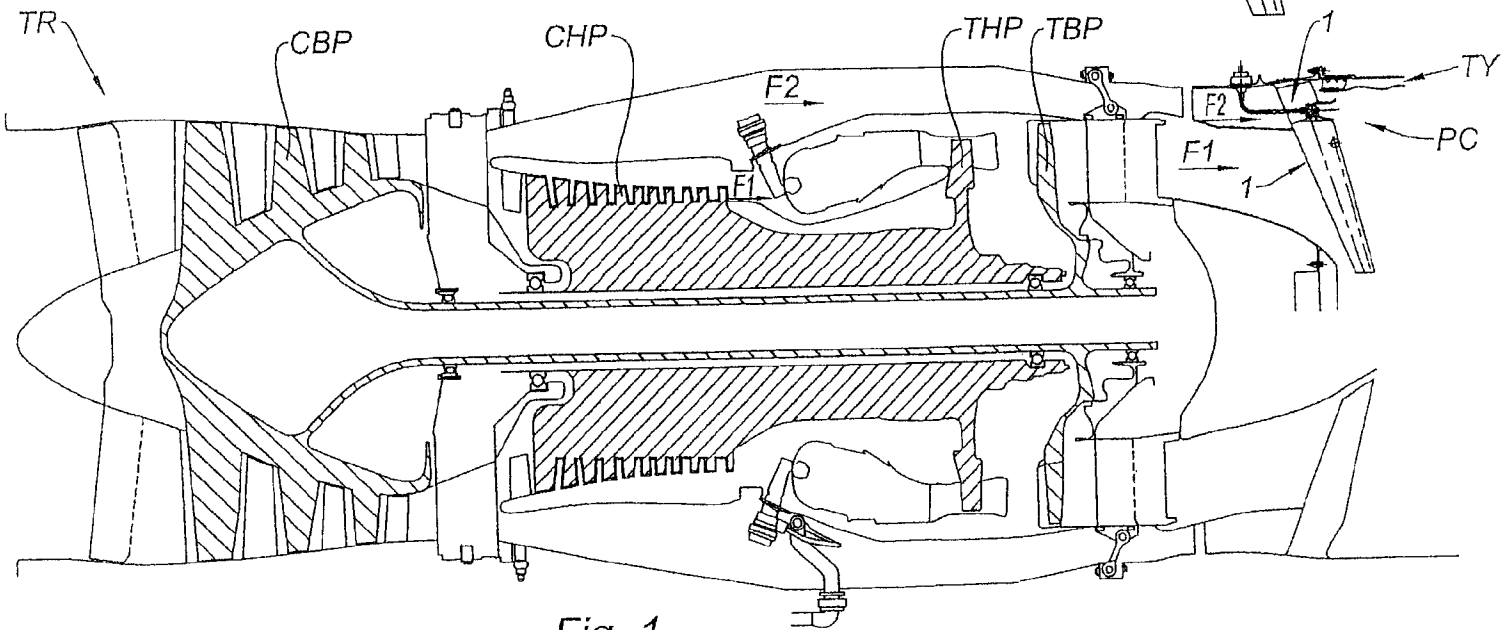
Fig. 1 BACKGROUND ART

The gap 11 between the legs 7,8 of the arm is indented, on the one hand, to be able to turn down the flanges 9,10 and, on the other hand, to allow room for a stream of fresh air to pass toward the bottom of a spray ring 12 that will be attached to a metal support fixedly attached to the rear of the arm (downstream side, see FIG. 2). The two edges at the rear of the arm 1 (at the opposite end to the leading edge 5) support two indents 13 at the height of the legs 7,8 to allow room for the spray ring and form placement hollows 13 for a ring support 12.

As shown in FIG. 4, the attachment plate 20 extends on a transverse plane. The support brackets 30,30' extend in a longitudinal direction.

The support brackets 30 are designed to be fixedly attached to the attachment plate 20 as detailed hereinafter.

In the embodiment of FIG. 4, the plate 20 is formed of a metal disk furnished with means of attachment to the casing. These means comprise positioning pins or threaded studs 21,22 that are engaged in holes 23 made on the casing C and orifices 24,25 for attachment screws or bolts 26 to pass through. The plate 20 is attached to the casing C by tightening nuts onto the threaded studs 21-22 and onto the fastening screws 26. The plate 20 comprises a flat surface 27 designed to serve as a brazing support for the two lateral support plates 30 of the arm 1, as detailed hereinafter.

According to the exemplary embodiment of FIG. 4, each bracket 30 is formed of a metal plate 31 extending in a direction that corresponds substantially to the longitudinal direction of the arm 1 or to the radial direction of the casing C, once the device 40 is attached to the casing C.

Figure 8:
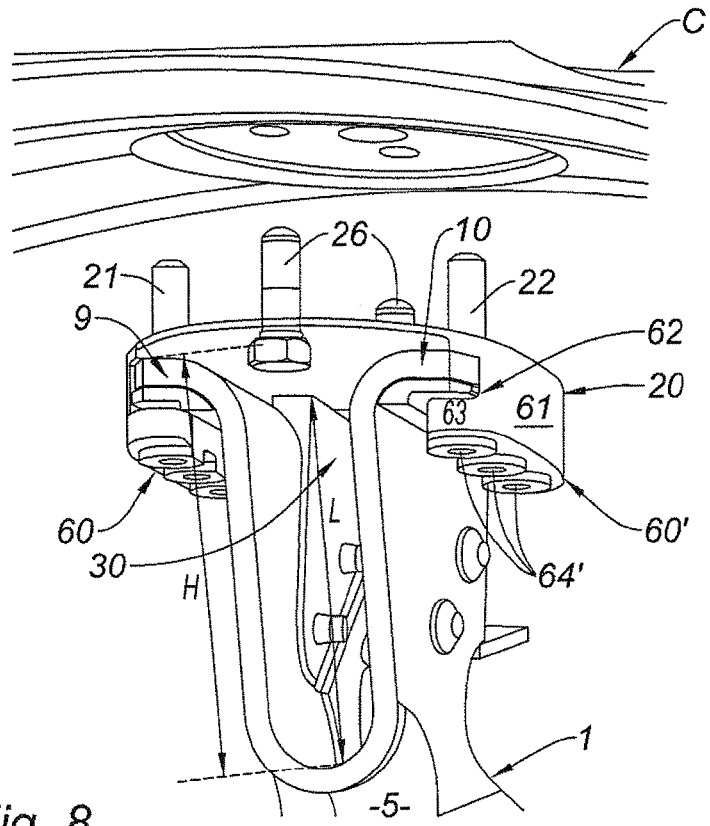

FIGS. 4 and 5 show that each bracket 30 has a flat surface 31 extending longitudinally over a length L corresponding to the height H of a leg 7,8 of the arm, or at least covering a major portion of the height H. The width W of the bracket 30 preferably also corresponds to a major portion of the width I of the leg 7,8 of the arm 1. FIG. 8 shows for example, in another embodiment, that the length L of the brackets 30 covers the whole height H of the legs 7,8 of the arm 1 from the level of the turned-down flanges 9,10 to the beginning of the leading edge 5.

Preferably, as illustrated in FIG. 4, the base 32 of each bracket, designed to press against the plate 20 for attachment to the casing C, comprises a widened base 32 that is sufficiently wide to be firmly brazed to the surface 27 of the plate 20.

The base 32 of each bracket 30 is thickened and forms a rim protruding toward the outside of the brackets.

The base 32 of each bracket has, at its end, a flat face P extending transversely (substantially perpendicular to the longitudinal direction of the bracket or of the flame-arrestor arm) and having a sufficiently extensive surface area to be fixedly attached by brazing to the surface 27 of the attachment plate 20.

Advantageously, provision is made for the outer lateral surface of the rim 32 of each bracket 30 to comprise a fillet 33, that is to say a concave shape having a rounded (or radiused) surface between the rim 32 and the flat portion 31 of the bracket 30. Advantageously, this rounded surface 33 hugs the curvature zone 17 or 18 between the leg 7 or 8 of the arm and the attachment flange 9 or 10 turned down at its end, as can be seen in FIGS. 5 and 6.

According to an alternative (not illustrated), the device may initially be made in a single piece, particularly by casting, the plate being originally fixedly attached to the side brackets that protrude perpendicularly from the plate (all in one piece).

Preferably, according to the second alternative, schematized in FIG. 4, the brackets 30 and the plate 20 are initially separated.

In the second alternative, the operating mode consists in assembling the support brackets 30, 30' with the corresponding legs 7,8 of the flame-arrestor arm 1, then in fitting the arm 1 furnished with the support bracket 30 onto the plate 20 and in attaching, particularly by brazing, the base 32 of the brackets 30 against the plate 20, as illustrated in FIG. 5. This provides an afterburner comprising a flame-arrestor arm 1 mounted on the support brackets 30,30' and on the plate 20 of the device 40, ready to be attached to the casing C.

As indicated in FIG. 5, the side brackets 30, 30' are held pressed against the inner face of the corresponding legs 7,8 and attached to the latter particularly by riveting, by screwing or by other assembly or fastening means.

Each support bracket 30 comprises, as illustrated in FIG. 4, fastening holes 34,35 for attaching the lateral walls 7,8 of the arm 1.

In the example of FIG. 5, rivets 36 are inserted through holes made in the legs of the CMC arm and through the attachment holes 34,35 pierced in the side brackets 30 of the device 40. The number and the diameter of the holes and the rivets 36 is calculated according to the value of the mechanical forces to be sustained.

The second alternative advantageously makes it possible to remedy a problem of variation of spacing of the legs 7-8 due to manufacturing tolerances of the flame-arrestor arm 1. Arms made of CMC usually have large manufacturing tolerances, such that the spacing of the legs 7-8 may undergo variations reaching the order of one millimeter typically. The spacing of the legs 7-8 must be perfectly adjusted to the dimension occupied by the brackets 30-30' to obtain a firm attachment by riveting 36 and for the arm 1 not to sustain any stress at rest.

Therefore, advantageously, provision is made to attach each side support bracket 30,30' to the corresponding leg 7,8 of the flame-arrestor arm 1, before fixedly attaching the support brackets 30 and 30' positioned longitudinally on the transverse plate 20. This makes it possible to remedy the problem of manufacturing tolerance of the legs 7,8 of the flame-arrestor arm 1.

Figures 6A, 6B:
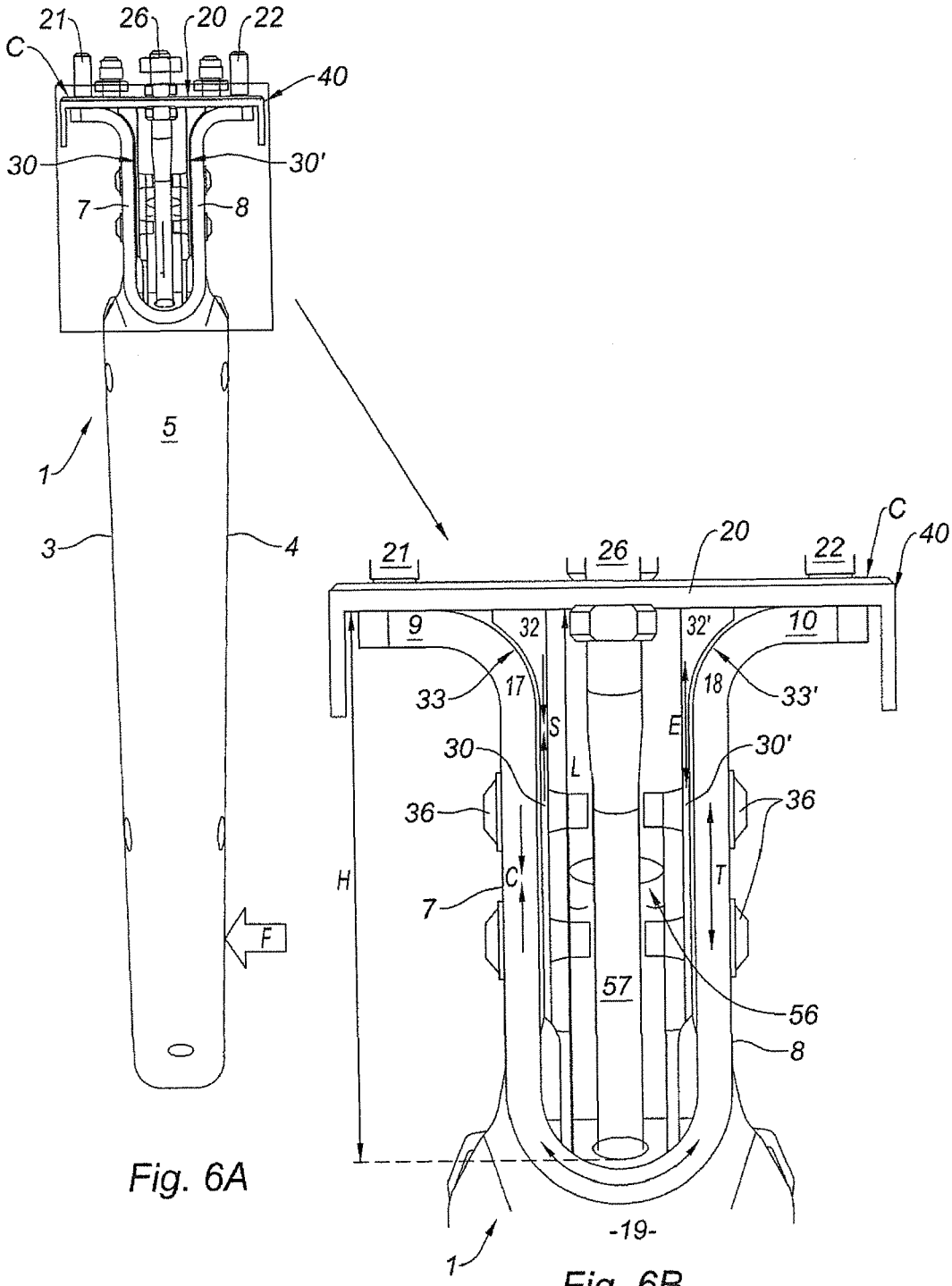
FIGS. 6A and 6B represent front views of a flame-arrestor arm and of its attachment to a casing with the aid of the device according to the invention, with a stress distribution diagram during a lateral force on the arm.

FIG. 6A shows a CMC flame-arrestor arm 1 attached to a casing with the aid of the attachment device 40 according to the invention. The enlarged view 6B indicates schematically the distribution of the compression stresses C,S and tension stresses T,E in the arm 1 and in the brackets 30 of the attachment device 40, when the arm 1 sustains a lateral force, in the direction indicated by an arrow F in view 6A.

As suggested by the arrows represented in view 6B, when the flame-arrestor arm 1 sustains lateral forces, particularly under the effect of the gyration of the flow in the stream, the compression and tension stresses that appear at the base of the arm 1 are at least partially transferred to and supported in the side brackets 30 of the device 40.

Advantageously, the side brackets 30 thus form side braces for the legs 7,8 of the arm 1 that resist a deflection or a twisting of the arm at its base. The legs 7-8 and the flanges 9-10 of the arm 1 sustain fewer stresses and deformations which reduces the risks of tearing or damage.

In addition, the zone of folding or of curvature 17/18 between each flange 9/10 and the corresponding leg 7/8 is retained by the rounded shape of the fillet 33 provided on the rim 32 of the bracket 30, which inhibits the risk of damage in this zone 17/18.

Thus, the attachment device 40 according to the invention advantageously makes it possible to retain laterally, to support and brace the flame-arrestor arm 1 against the lateral forces F and the risks of deflection or twisting.

Figure 7:
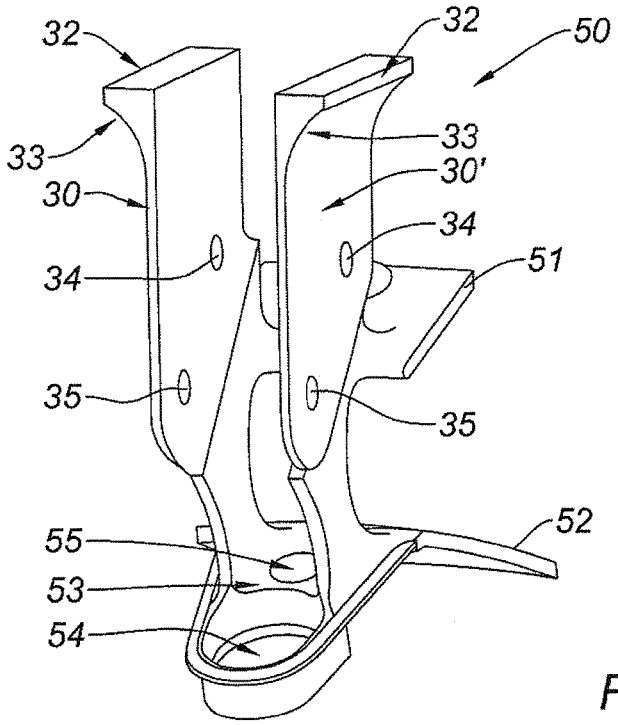
FIG. 7 represents another embodiment of the afterburner attachment device according to the invention which forms both a support for a flame-arrestor arm and a support for a spray ring; and, FIG. 8 shows the mounting on a casing of an afterburner attachment device according to the embodiment of FIG. 7.

FIG. 7 illustrates another embodiment of the attachment device 50 according to the invention, in which the device 50 also serves as a spray ring support.

The side brackets 30,30' of the device 50 are extended longitudinally and connected to at least one, here two, spray ring segment support flanges 51,52.

According to the example of FIG. 7, the brackets 30,30' and the flanges 51,52 may be formed in a single piece particularly in the form of a single support piece 50, obtained by casting.

In addition to the two side brackets 30-30' extending in a longitudinal direction, the support piece 50 consists of a bridge connector 53 transversely joining the two side brackets 30-30' and of the transverse spray ring segment support flanges 51,52.

FIG. 8 shows that the side brackets 30,30' extend longitudinally over a length L corresponding to the height H separating the level of the attachment flanges 9,10 at the end of the arm 1 and the level of the ring sector on the arm (which advantageously makes it possible to relieve the forces sustained by the legs 7-8 of the arm).

In the exemplary embodiment of FIG. 7, the device comprises two flanges 51,52 protruding downward and connected by their upstream edge to the downstream edges of the two longitudinal brackets 30 and 30'. The two flanges 51 and 52, here consisting of two plates disposed in a dihedron, form two bearing faces placed like the symbol < that is open downstream. The support flanges 51,52 allow the assembly of one or two spray ring segments. The support flanges 51,52 may be pierced with attachment holes for assembling the ring segments.

FIG. 7 again shows that one of the ring support flanges 52 is placed at the transverse wall of the bridge connector 53 which joins the two longitudinal brackets. The transverse flange 52 consists of an extension of the bridge connector 53 in the half-space downstream. The bridge connector 53 and the flange 52 are situated here at the summit of the piece 50 (toward the axis of the jet) and form a transverse link between the summit ends of the side brackets of the piece. The other flange 51 is placed transversely at an intermediate level between the base 32 and the summit 53 of the piece.

The bridge connector 53 braces the transverse link of the brackets 30-30' and stiffens the device 50.

In addition, the bridge connector 53 forms a transverse wall which advantageously makes it possible to separate the primary flow F1 of burning gases that is propagated in the central part of the turbojet and the secondary flow F2 of fresh air that is propagated at the periphery of the turbojet.

The primary flow is formed by the burnt gases originating from the combustion of the fuel with the air in the turbojet combustion chambers and discharged toward the outlet of the turbojet. The secondary flow is formed of fresh air, that is to say of air that is not burnt and is at a relatively cold temperature relative to the burning gases of the primary flow. This fresh air may serve precisely as a combustive element to the afterburning, particularly at the spray ring and/or at the flame-arrestor arm. It is preferable that the primary and secondary flows do not mix. In particular, it is advisable to prevent leaks of pressurized secondary fresh air flow toward the stream of the primary flow so as not to reduce the pressure of the fresh air flow and to obtain an optimal supply of a ventilation sleeve placed in the flame-arrestor arm. Secondarily, it is advisable to prevent the fresh air flow from being polluted by the burnt gases.

As the example of FIG. 2 shows, this secondary fresh air flow F2 is propagated at the periphery of the turbojet TR, in particular between a metal sheet of confluence and the external skirt of the casing.

The transverse wall formed by the bridge connector 53 advantageously makes it possible to provide continuity of partitioning of the confluence metal sheet which separates the secondary peripheral stream, in which the fresh air flow F2 circulates, from the main stream in which the burnt gas flow F1 is discharged. Such a configuration ensures a seal between the stream of the secondary flow F2 at the periphery and the stream of the primary flow F1 at the center.

The transverse wall formed by the bridge connector 53 is placed at the summit portion of the support piece 50 and in the extension of one of the two support flanges 52, more precisely in the extension of the summit flange 52 which supports the inner side of the spray ring segments. The spray ring segments are then entirely on the side of the wall of the bridge connector 53 exposed to the secondary fresh air flow.

The secondary fresh air flow F2 may thus reach the bottom of the spray ring segments 12 without losing pressure or mixing with burnt gases. In addition, the secondary fresh air flow may reach, without losing pressure, the entrance of a ventilation sleeve 56 (see FIGS. 6A-6B) that is engaged and attached in an orifice 54 made in the bridge connector.

This first orifice 54, of large diameter, made upstream of the bridge connector 53, is used to engage and attach the tubular ventilation sleeve 56 which is inserted in the bottom of the trough-shaped flame-arrestor arm 1. The ventilation sleeve 56 makes it possible to bring the cooling fresh air flow to the bottom of the flame-arrestor arm 1, this air flow also serving as combustive element at afterburning.

FIG. 7 again shows that the wall of the bridge connector 53 may be pierced with another orifice 55 to house another afterburner element.

This second orifice 55, of small diameter, made in the mid-part of the bridge connector 53, is used for passing and holding in place a fuel injection bank 57 inside the flame-arrestor arm 1 (see FIG. 6B). The bank 57 injects jets of fuel, laterally, along the arm 1.

The assembly formed by the side brackets 30,30' for supporting the flame-arrestor arm, the spray ring segment support flange or flanges 51,52, and the transverse wall of the bridge connector 53, where necessary furnished with orifice(s) 54,55 for housing a ventilation sleeve 56 and/or an injection bank 57, advantageously forms a single support piece 50 for the assembly of all these afterburner elements.

Such a support piece 50 may, from the outset, be fixedly attached to an attachment plate 20, as previously explained, to form a one-piece attachment device obtained for example by casting a single piece.

Alternatively, the device may be made in two separate pieces: on the one hand, the support piece 50 as illustrated in FIG. 7 and, on the other hand, the attachment plate 20 as previously explained. Once the flame-arrestor arm 1 is fitted and attached to the support brackets 30,30', the support piece 50 and the plate 20 are brought together and fixedly attached, particularly by brazing.

FIG. 8 shows that, in addition, according to an enhancement, the flame-arrestor arm 1 may be attached directly to the plate 20, the plate 20 being furnished with means 60,60' for immobilizing the attachment flanges 9,10 at the base of the flame-arrestor arm 1. Provision is made to immobilize the two flanges 9,10 in two grooves or two lateral recesses made in two rims 61 of the plate 20 and performing the function of lateral grips.

In this variant embodiment appearing in FIG. 8, the plate 20 comprises two lateral edges 61 protruding perpendicularly from the transverse plate 20. Each longitudinally protruding edge 61 comprises, on its inner side, a recess 62 arranged under a turned-down rim 63 on the inner side of the plate 20 which performs a hook function.

The two lateral recesses 62 are dimensioned so that the flanges 9,10 of the flame-arrestor arm 1 slide inside while inserting a compression shim.

The flanges 9,10 are immobilized in the lateral recesses 62 of the plate 20 with the aid of clamping screws 64' that are engaged in threaded holes. The holes are tapped, parallel to the longitudinal axis, in the rims 63 and open into the corresponding recess 62. The clamping screws 64' pass through the rims 63 in the longitudinal direction to emerge inside the recess 62. The screws 64 press on the compression shim which clamps the flange 9 or 10 to immobilize it. The compression shim may be furnished with a rounded side to hug the outside of the curve 17 or 18 of the material between the flange 9 or 10 and the leg 7 or 8 of the flame-arrestor arm 1.

When the flame-arrestor arm 1 is assembled onto the support piece as illustrated in FIGS. 6A and 6B, the legs 7 and 8 of the arm 1 naturally press against the lateral walls 31 of the elongated support brackets 30.

The flame-arrestor arm 1 may then be attached to the device, on the one hand, by fixedly attaching the legs 7 and 8 to the side brackets 30,30' with the aid of fastening means (particularly by riveting 36 or screwing) and, on the other hand, by immobilizing the flanges 9 and 10 of the arm 1 in the rims 60 and 60' of the plate 20, the latter being fixedly attached to the brackets 30,30' of the device.

Advantageously, as shown in FIG. 6, the indented legs 7 and 8 of the arm 1 that comprise the zones 17,18,19 most exposed to risks of damage, are then structurally braced by the metal brackets 30 and 30' of the attachment device according to the invention.

Thus, as schematized in view 6B, the lateral forces F applied to the arm 1 are transferred to and absorbed at least at the S and E portion by the side brackets 30,30' of the attachment device and are transmitted directly to the casing C.

Subsequently, the legs 7-8 and the flanges 9-10 of the flame-arrestor arm 1 are no longer subjected to stresses risking to cause their deformation (deflection, twisting) or their damage under the effect of the lateral forces.

Advantageously, the fold or curvature zones 17 and 18 of the flanges 9 and 10 for attaching the arm 1 rest against the rounded surfaces 33 made on the rims 32 at the base of the brackets 30 and 30' for supporting the device according to the invention. In addition, the external surface of the curvature zone 17,18 of each flange 9,10 may be in contact with the rounded edge of the compression shim.

Thus, the attachment of the flame-arrestor arm 1 to the casing C thanks to the device according to the invention makes it possible to remedy risks of damage to the arm 1 (particularly by deflection, twisting, folding or tearing).

Advantageously, according to the invention, the flame-arrestor arm 1 may be fixedly attached at several points of connection with the attachment device 40. The extended surfaces of the immobilization shims 60,60' of the flanges 9,10 may be added to the many attachment points 34,35 on each bracket 30.

In addition, thanks to the invention, the weight and the forces exerted by the spray ring segments are no longer supported by the flame-arrestor arm 1, but directly transmitted via the support piece 50 and the attachment plate 20 to the casing.

In general, the invention makes it possible to have a device 40/50, for attaching a flame-arrestor arm 1, that is easy to remove and attach to the casing C, and makes it possible to form a complete afterburner that is easily interchangeable.

The device 40/50 for attaching the flame-arrestor arm according to the invention therefore offers real advantages without significantly increasing the weight of the afterburner.

The invention claimed is:

1. An attachment device for attaching an afterburner to a turbojet casing, the afterburner comprising a flame-arrestor arm comprising first and second legs each with a longitudinal portion extending longitudinally, an attachment flange extending transversely, and a curvature portion connecting the longitudinal portion with the attachment flange, the attachment device comprising:

a transverse plate which attaches to an inner radial surface of the casing; and first and second brackets which support said first and second longitudinal legs, respectively, each of the first and second brackets including a thickened base portion with a transverse flat face which abuts the transverse plate and a leg portion extending longitudinally from the base portion, wherein the transverse flat face is parallel to the transverse plate and perpendicular to the leg portion for each of the first and second brackets, wherein the leg portion of each of the first and second brackets is parallel to the longitudinal portion of each of the first and second legs, wherein an inner surface of the longitudinal portion of the first and second legs abuts an outer surface of the leg portion of the first and second brackets, respectively, and wherein a fillet is provided between the base portion and the leg portion in each of the first and second brackets.

2. The attachment device as claimed in claim 1, wherein the leg portions of the first and second brackets extend longitudinally over a length corresponding to at least a substantial portion of a height of the first and second longitudinal legs of the flame-arrestor arm.

3. The attachment device as claimed in claim 1, wherein the first and second brackets comprise a fixing device which attaches the two longitudinal legs of the flame-arrestor arm.

4. The attachment device as claimed in claim 1, wherein the transverse flat face of the thickened base portion of each of the first and second brackets is the transverse plate.

5. The attachment device as claimed in claim 1, wherein the thickened base portion of each of the first and second brackets is fixedly attached to the transverse plate.

6. The attachment device as claimed in claim 1, wherein the transverse plate includes an attachment unit which attaches to the casing.

7. The attachment device as claimed in claim 1, further comprising at least one spray ring support flange.

8. The attachment device as claimed in claim 1, further comprising a transverse wall which transversely connects the leg portion of the first bracket and the leg portion of the second bracket.

9. The attachment device as claimed in claim 8, wherein the transverse wall includes at least one orifice which passes and immobilizes at least one of a ventilation sleeve or a fuel injection bank.

10. The attachment device as claimed in claim 1, wherein the transverse plate includes edges provided on an internal side, with a groove and a protruding rim forming lateral hooks to immobilize the attachment flanges of the flame-arrestor arm.

11. The attachment device as claimed in claim 10, wherein the edges of the transverse plate are furnished with an immobilizing device which immobilizes the attachment flanges of the flame-arrestor arm.

12. The attachment device as claimed in claim 10, wherein the edges include at least one of longitudinal threaded holes or caging bolts.

13. The attachment device as claimed in claim 10, further comprising at least one shim which immobilizes and/or compresses at least one of the attachment flanges for attachment of the flame-arrestor arm.

14. An afterburner, comprising the flame-arrestor arm and the attachment device as claimed in claim 1.

15. The afterburner as claimed in claim 14, further comprising at least one spray ring segment.

16. A turbo-engine, comprising at least one afterburner as claimed in claim 14.

17. The attachment device as claimed in claim 1, wherein a first surface of the transverse plate is attached to a recessed surface of the inner radial surface of the casing, and a second surface of the transverse plat; opposite the first surface of the transverse plate, is in contact with the first and second brackets.

* * * * *

UNITED STATES PATENT AND TRADEMARK OFFICE

CERTIFICATE OF CORRECTION

PATENT NO. : 7,886,542 B2
APPLICATION NO. : 11/566406
DATED : February 15, 2011
INVENTOR(S) : Stephane Pierre Guillaume Blanchard et al.

It is certified that error appears in the above-identified patent and that said Letters Patent is hereby corrected as shown below:

Column 1, line 41, change "1000°C. to 1500°C.," to --1000°C to 1500°C,--;

Column 10, line 26, claim 17 change "plat;" to --plate,--.

Signed and Sealed this
Fourteenth Day of June, 2011

David J. Kappos

David J. Kappos
*Director of the United States Patent and Trademark Office*